US005419247A

United States Patent [19]

Bachmann

[11] Patent Number: 5,419,247

[45] Date of Patent: May 30, 1995

[54] APPARATUS FOR INKING AN INK BALL PRINTING PLATE

[75] Inventor: Louis Bachmann, Wil, Switzerland

[73] Assignee: Teca-Print AG, Thayngen, Switzerland

[21] Appl. No.: 62,246

[22] Filed: May 17, 1993

[30] Foreign Application Priority Data

May 15, 1992 [CH] Switzerland ..... 1567/92

[51] Int. Cl.[6] ..... B41F 31/02

[52] U.S. Cl. ..... 101/364; 101/318

[58] Field of Search ..... 101/364, 318, 341, 340, 101/339, 338, 44, 335, 333, 163, 35, 41–44

[56] References Cited

U.S. PATENT DOCUMENTS

| | | | |
|---|---|---|---|
| 3,207,070 | 3/1962 | Klingler et al. | 101/366 |
| 4,484,827 | 11/1984 | Price, Jr. | 101/335 |
| 4,557,195 | 12/1985 | Phlipp | 101/163 |
| 4,905,594 | 3/1990 | Phillip et al. | 101/163 |
| 5,003,872 | 4/1991 | Dalferth | 101/364 |
| 5,017,291 | 5/1991 | Semler et al. | 101/366 |
| 5,042,382 | 8/1991 | Yamazaki et al. | 101/333 |
| 5,222,433 | 6/1993 | Philipp | 101/163 |
| 5,237,922 | 8/1993 | Ho | 101/333 |

FOREIGN PATENT DOCUMENTS

| | | | |
|---|---|---|---|
| 2205430 | 6/1981 | Germany | 101/160 |

*Primary Examiner*—Edgar S. Burr
*Assistant Examiner*—Anthony H. Nguyen
*Attorney, Agent, or Firm*—Sughrue, Mion, Zinn, Macpeak and Seas

[57] ABSTRACT

An ink container 1 has an open bottom surrounded by a closed sidewall 3 whose lower edge 3*a* bears against the upper surface of a flat printing plate 15. Ink 31 in the container is applied to the plate as the latter is reciprocated horizontally. An apertured baffle disk 10 is disposed within the container just above its open bottom, and prevents the ink from being frictionally drawn to one side by the moving plate. This assures a more uniform inking of the plate, and enables a lower ink level to be tolerated before the container has to be refilled.

10 Claims, 3 Drawing Sheets

19
24
21
17
16
15'
13
14
7
50
36
18

59
60
56
54
57
52
51
64
14
50
58
55
53
62
A
65
66
67
15

50a
52
64
14
53
50

APPARATUS FOR INKING AN INK BALL PRINTING PLATE

BACKGROUND OF THE INVENTION

This invention relates to an ink container for inking a block or plate of an ink ball printing machine, the ink container being open at its underside and having an edge which rests to rest snugly against the printing plate.

An ink container of this type is disclosed in DE-C-1 923 374. With such an ink container a block, from which the ink is transferred to an object to be printed by means of a stamp or an ink ball, can be inked by machine and with very high efficiency. In practice this ink container for ink ball printing machines has proven to be reliable and has become very wide spread.

With a filled ink container a block can be inked until there is only a specific amount of ink remaining in the container. If the block is further inked with this residual amount of ink, the inking is incomplete and the distribution of ink over the block is nonuniform. Correspondingly, the print is not satisfactory. Therefore, upon reaching the residual amount of ink the ink container must be refilled very early.

SUMMARY OF THE INVENTION

The invention is based on the problem of providing an ink container of the aforementioned type that does not have to be refilled as frequently. Thus, the ink container, according to the invention, enables longer printing with the same amount of ink with high quality. This problem is solved by disposing a device to level out the ink within the ink container. The consequence of leveling out the ink is that with the residual amount of ink the distribution of ink over the block is significantly more uniform. With the ink container of the invention one can print even longer with adequate quality with the residual amount of ink until finally the amount of ink remaining in the ink container is significantly less. Thus, with the ink container according to the invention one can print longer with the same amount of ink since the block is optimally covered. The residual amount of ink at which it becomes necessary to refill the ink container is correspondingly smaller than with prior art ink containers.

In one embodiment of the invention the leveling device is formed by a disk or plate, which is arranged in the ink container. Preferably the disk or plate is aligned parallel to the upper side of the printing plate. The distance from the disk or plate to the upper side of the printing plate is based on the properties of the ink and in particular its viscosity. A distance of less than 10 mm has proven to be optimal. Such an ink container is comparatively simple to make and thus inexpensive and also simple to handle.

A disk or plate exhibiting a perforation or several holes has proven to be especially effective. Such a disk or plate can extend substantially over the entire opening of the ink container. Correspondingly it is possible to level out the ink in essence over the entire region of the ink container.

An especially simple and good mounting of the disk or plate is achieved, according to another aspect of the invention, if the cover wall on the inside of the body of the ink container exhibits a downwardly projecting shoulder, to which the disk or plate can be detachably attached. This shoulder can serve simultaneously to accommodate a joint and in particular a ball joint in order to suspend a pot.

According to another embodiment of the invention, the leveling device is formed by a low cover wall of the ink container and an ink reservoir is provided that is connected to the interior of the ink container. Preferably the cover wall is arranged less than about 20 mm above the upper slde of the printing plate. Even with this very low ink container, the residual amount of ink can be held significantly smaller than before. Another advantage of such an ink container is the better temperature constancy and the control of the viscosity of the ink in the reservoir.

The control of the viscosity and the constancy of the temperature is guaranteed to be especially reliable, if, according to another embodiment of the invention, a circulating pump is provided in a line between the ink container and the reservoir. The amount of ink in the reservoir can then be significantly greater than in the ink container. Then a large percentage of the heat generated in the ink container during service can be very quickly dissipated into the reservoir. In addition, a temperature increase in the ink container and thus also a change in the viscosity of the ink can be held very low.

DETAILED DESCRIPTION OF THE PREFERRED EMBODIMENTS

Figure 1:
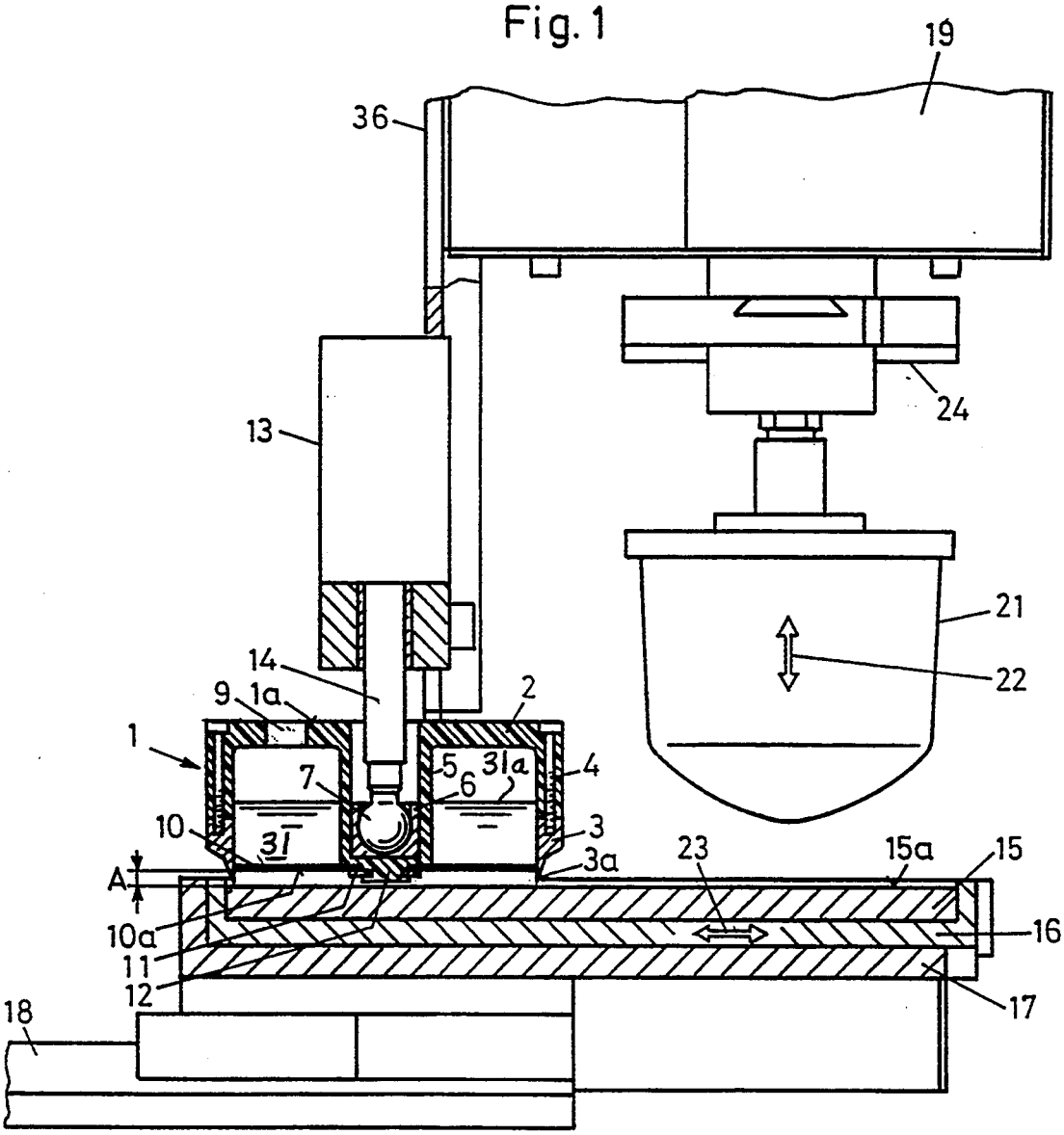
FIG. 1 is a partially fragmented sectional view of an ink ball printing machine with an ink container according to the invention.

The ink ball printing machine shown in FIG. 1 has a machine frame 36, to which a guide 18 is attached, on which a carriage 17 with a plate carrier 16 and a printing plate 15 can be moved back and forth in the direction of the arrow 25 by means of a drive (not shown). Above the printing plate 15 is an ink container 1, whose comparatively sharp edge 3*a* rests against the flat upper side 15*a* of the printing plate 15. To ink the printing plate 15 ink 31 is filled into the container 1. An opening 9 in a cover wall 1*a* of the ink container 1 prevents an overpressure being generated in the ink container 1. To the inside of the cover wall 1*a* is attached a downwardly projecting, cylindrical post or shoulder 5, to whose bottom end a disk 10 is attached or mounted detachably. In addition, a bearing box 6, which forms with the front spherical end 7 of a piston 14 a ball joint, is inserted from the outside in the shoulder. The piston 14 belongs to a cylinder printing unit 13, which is attached to the machine frame 36. The ball joint and the unit 13 form a supporting frame, which presses uniformly and at constant pressure the ink container 1 against the upper side 15*a*. Thus, it is guaranteed that ink 31 is uniformly applied while the printing plate 15 is moving in the direction of the arrow 23.

The ink container 1 exhibits a ring 3, made for example of steel, which is attached with bolts 4 to a plastic body 2. The ring 3 forms the edge 3*a*, which seals and is pointed like a wedge. With the ball joint connection the edge 3*a* will always rest snugly against the surface 15*a* even if the surface is not in accurate horizonal alignment.

The ink 31 is consumed when the printing plate 15 is inked; and correspondingly the surface 31*a* of the ink 31 drops. When the printing plate 15 is moved relative to the ink container 1, the ink 31 is moved in the ink container 1. So that the surface 31*a* of the ink 31 is disturbed only insignificantly by this movement, the disk 10 is arranged in such a manner that a bottom surface 10*a* of the disk is aligned parallel to the upper side 15*a* of the printing plate 15. The distance A between the surface 10*a* and the upper side 15*a* is a function of the physical properties of the ink 31 and size of the ink container 1. However, with the typical ink container 1 and the typical ink 31 this distance A is less than 20 mm and preferably less than 5 mm. To clean the ink container and the disk 10, the latter is attached detachably to the shoulder 5 by means of a clamping ring 11 or the like. Preferably, however, the disk 10 is mounted floatingly to the shoulder 5, a feature that simplifies the cleaning. However, conceivable is also a design, in which the disk 10 is not attached to the center, but rather to the outer edge at the body 2 or at the ring 3 or mounted floatingly.

FIGS. 2*a* to 2*d* depict embodiments of the disk 10. The disks 10, 20, 30 and 40, shown in the drawings here, are made, for example, of a suitable plastic or metal have a thickness of 5 mm, for example, and a diameter of 90 mm, for example.

Figure 2A:
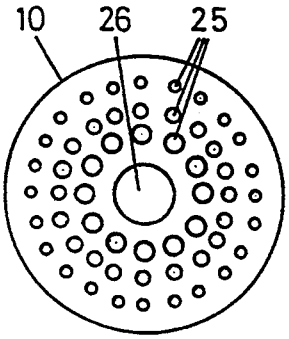
FIGS. 2*a* to 2*d* are views of different designs of a disk disposed in the ink container.
Figure 2B:
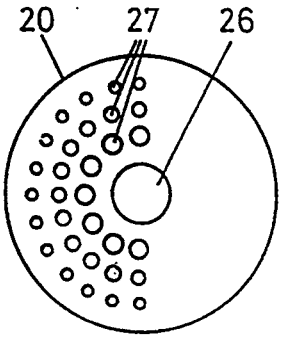

The disk 10, shown in FIG. 2*a*, has several openings 25, which increase in size as the distance to an attachment opening 26 decreases. The largest opening 25 has preferably a width of 5 mm and the smallest opening 25 a width of 3 mm, for example.

Disk 20 also has several identical continuous openings, but only over one half of the disk 20.

Figure 2C:
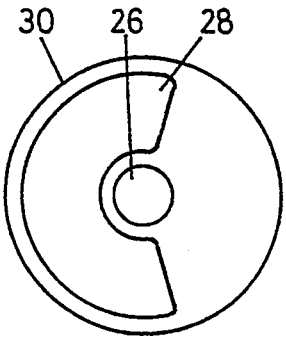

The disk 50, shown in FIG. 2*c*, has only one opening 28, which extends, however, in essence over one half of the disk 50.

Figure 2D:
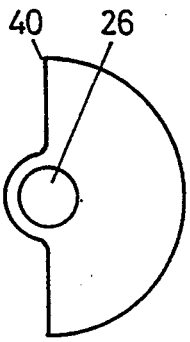

Finally a disk 40 is provided in FIG. 2*d* that has in essence the shape of a semicircle.

The openings 25, 27 and 28 enable the ink to pass from one side of the disk 10, 20 or 30 to the other side. With the disk according to FIG. 2*d* a corresponding opening can be dispensed with, since here the ink can circulate next to the disk 20 around it.

The disks, shown in FIGS. 2*a* to 2*d*, are merely embodiments of a suitable disk. Conceivable are also unround disks or plates. In the case of a rectangular or, for example, oval ink container 1 the disk or plate disposed in the ink container can be designed correspondingly rectangular or elliptical. Finally a design is conceivable in which the surface 10*a* is formed by means of a shoulder moulded to the body 2. For example, the bottom end of the shoulder 5 could be expanded into the shape of a disk.

Next to the ink container 1 is a well-known ink ball 21, which is attached to a carrier 19 by means of a guide 24 and which can be moved vertically in the direction of the arrow 22 with a drive (not shown). With this ink ball 21 ink is absorbed by the printing plate and applied to an object to be printed. Suitable is any disk or plate 10, 20, 30 or 40, which has at a comparatively small distance A from the upper side 15*a* to the surface 10*a*, which with a comparatively small residual amount of ink remains, and which distributes this amount of residual ink during a relative movement between the ink container 1 and the printing plate 15.

Figures 3A, 3B, 4:
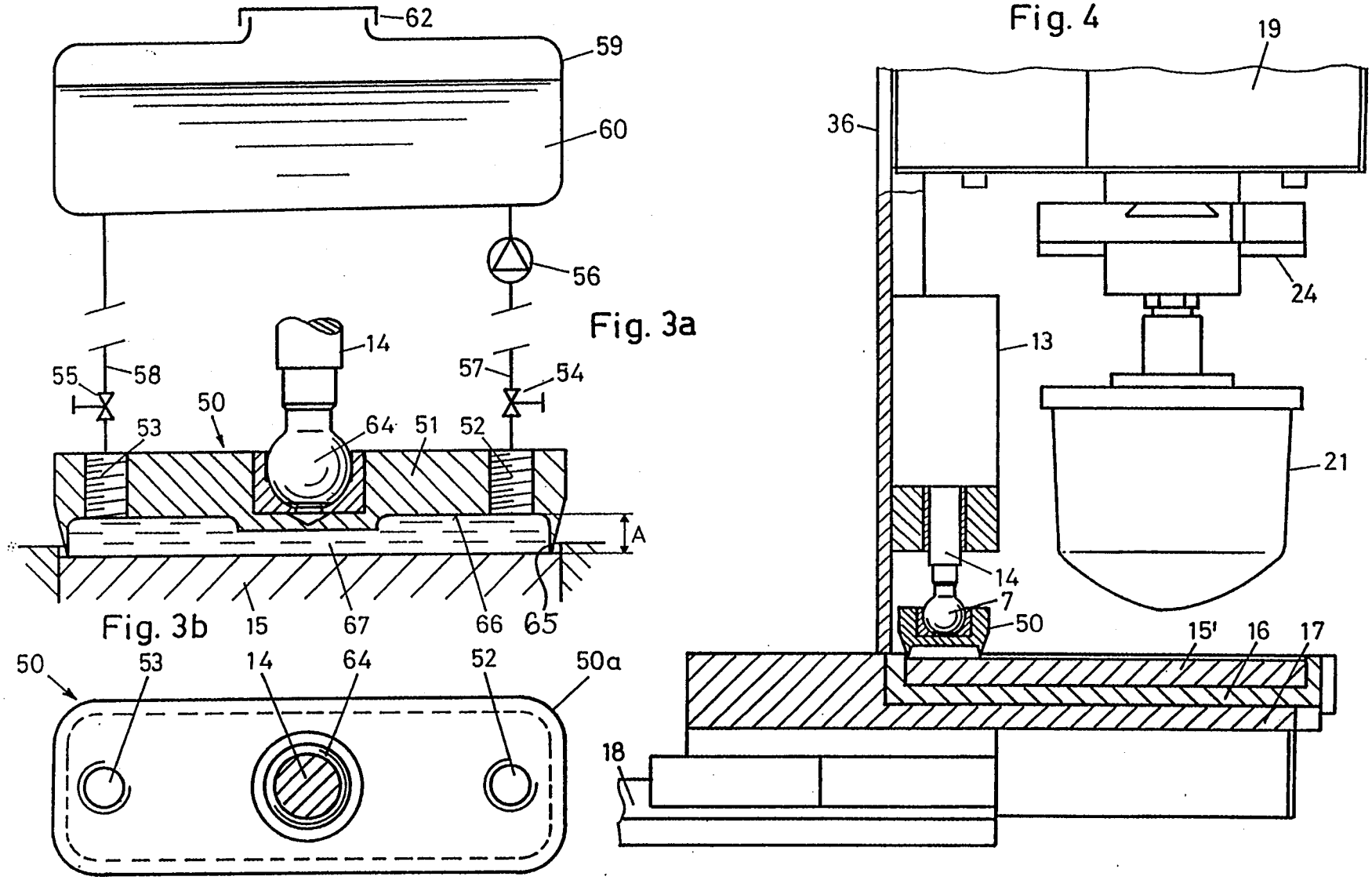
FIGS. 3*a* and 3*b* are views of one modification of an ink container according to the invention.
FIG. 4 is a partially fragmented sectional view of an ink ball printing machine with an ink container according to FIGS. 3*a* and 3*b*.
Figure 5A:
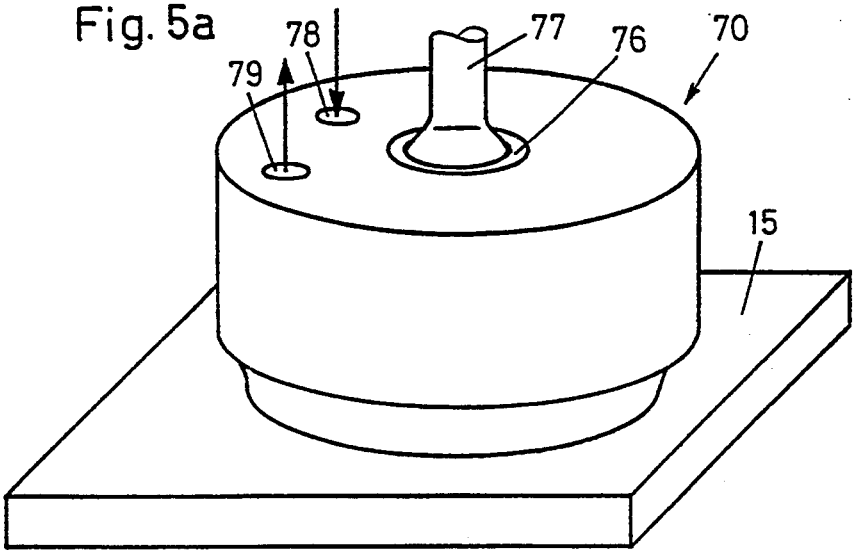
FIG. 5*a* is a perspective view of a printing plate with an ink container according to another modification.
Figure 5B:
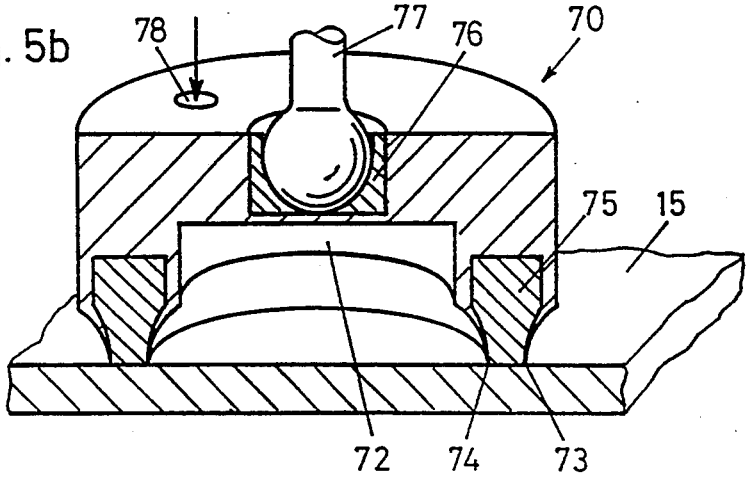
FIG. 5*b* depicts a printing plate with a sectioned ink container according to FIG. 5*a*.
Figure 6:
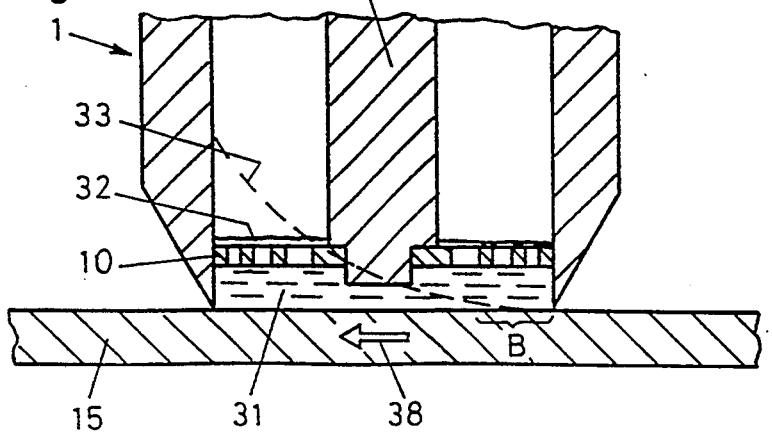
FIG. 6 is a diagrammatic, sectional view of an ink container with ink and a sectional view of a printing plate.

With the aid of FIG. 6 the operating mode of the disk 10 is explained in brief. It is assumed that there is a residual amount of ink 31 in the ink container 1. When the printing plate 15 moves in the direction of the arrow 38, the residual amount of ink 31 is drawn with it, and the surface 32 will then assume the slightly inclined shape that is shown. Without the disk 10, however, the upper side 32 would exhibit a significantly greater slope, as shown by the dashed line 35. In the case of an ink container 1 without disk 10, the residual amount of ink 31 would be greatest on the left side when the printing plate 15 is moving, whereas the right side of the ink container would contain little or even no ink. The consequence would be that the region of the printing plate 15, denoted here as B, would be incompletely or not inked with ink. Thus, disk 10 constitutes surface level assuring means to maintain a substantially constant depth of ink in container 1 and without disk 10 the ink container 1 would have to be refilled much more frequently. In the case of a residual amount of ink 31 with the significantly more uniform surface 32, however, the region B is still adequately covered with ink and is correspondingly also totally inked. Therefore, one can still work satisfactorily for some time with the residual amount of ink FIGS. 3*a* and 3*b* show an ink container 50 having a lower edge 65, which is connected to an ink reservoir 59 by means of lines 57 and 58, The line 57 connects an opening 52 in a cover wall 51 of the container 50 to the ink reservoir 59; and the line 58 connects an opening 53 of the container 50 to the ink reservoir 59. Ink can be exchanged between the two containers 50 and 59 with a circulating pump 56 arranged in the line 57. The ink circulates then in the lines 57 and 58 and in the containers 50 and 59. The amount of ink 67 accommodated in the container 50 is preferably many times smaller than the amount of ink 60 present in the ink reservoir 59. As is apparent, the container 50 is formed low and exhibits an inner surface 66 at distance A from the upper side of the printing plate 15. The interior of the container 50 is preferably totally filled with ink. As FIG. 3*b* shows, the container 50 is designed rectangular and oblong with round edges 50*a*. Here too, the container 50 is suspended with the ball joint, described above, and a cylinder unit. The ink container 50 has the advantage over a circular ink container in that the relative movement between the ink container 50 and the printing plate 15 can be shorter. To regulate the circulation of the ink, valves 54 and 55 are disposed in the lines 57 and 58. To refill the ink reservoir 59 it has a removable cover 62. The container 59 can also exhibit well-known arrangements to monitor the viscosity and the temperature. As a consequence of the high ink reserve in the container 59, on the one hand, and the very small amount of ink that is carried by the low container 50, on the other hand, one can print a very long time with the container 50 at high quality without having to refill.

FIG. 4 shows an ink ball printing machine, which is provided with a container 50 and which is designed, moreover, as the machine described with the aid of FIG. 1. However, the printing plate 15' can be significantly shorter here than the printing plate 15 of the ink ball printing machine according to FIG. 1. Correspondingly, of course, the carriage 17 has to be slid a shorter distance to ink the printing plates 15'. Thus, it is possible to ink the printing plate 15 correspondingly faster.

FIGS. *5a* and *5b* show finally an ink container 70, which, like the container 50, is designed low and is connected to an ink reservoir (not shown) by way of openings 78 and 79. In contrast, the ink container 70 is designed, however, cylindrical and defines a chamber 72, which is also cylindrical and open at the bottom and has two concentric edges 73 and 74. So that these edges 73 and 74 abut snugly during a relative movement between the printing plate 15 and the ink container 70, here, too, a ball joint is provided with a bearing 76 and a piston 77. Thus, like the ink container 1, the container 70 can be held at a unit 13 and can be pressed against the printing plate 15. With the container 70 a very long printing duration with only negligible heating up of the ink and at high viscosity constancy is possible.

I claim:

1. An apparatus for applying ink to an upper surface (15*a*) of an ink ball printing plate, said apparatus comprising:

a) an inverted ink container (1; 50; 70) having a continuous lower edge (3*a*,65; 73,74) surrounding an open underside of the container, said lower edge being disposed in sliding contact with the upper surface of the printing plate, b) means for effecting a relative movement between the printing plate and the ink container, and c) surface level assuring means disposed within the container, proximate the upper surface of the printing plate, for preventing an upper surface of ink in the container from becoming substantially inclined to a horizontal plane due to the ink being frictionally drawn in a direction of relative movement between the printing plate and the ink container, thereby enabling a continuing printing operation with a relatively low static ink depth in the container.

2. An apparatus as claimed in claim 1, wherein the Level assuring means comprises a baffle disk or plate (10, 20, 30, 40).

3. An apparatus as claimed in claim 2, wherein the baffle disk or plate (10, 20, 30) has at least one opening (25, 27, 28) for the passage of ink.

4. An apparatus as claimed in claim 2, including a downwardly projecting post inside said ink container (5) to which the baffle disk or plate is detachably attached.

5. An apparatus as claimed in claim 2, wherein the baffle disk or plate is floatingly mounted in the container.

6. An apparatus as claimed in claim 1, wherein the distance from the level assuring means to the plate surface is less than 20 mm.

7. An apparatus as claimed in claim 6, wherein the level assuring means (10*a*, 66) extends substantially over the entire open underside of the ink container (1, 50, 70), and in parallel to a plane including the lower edge (3*a*, 65).

8. An apparatus as claimed in claim 1, wherein the level assuring means is formed by an upper wall (66) of the ink container (50), and further comprising a large volume ink reservoir (59) connected to the ink container for supplying ink thereto.

9. An apparatus as claimed in claim 8, further comprising a circulating pump (56) for exchanging ink between the ink container and the ink reservoir.

10. An apparatus as claimed in claim 9, wherein said lower edge comprises concentric, outer and inner edges (73, 74).

* * * * *